US008584832B2

(12) United States Patent
Depoi et al.

(10) Patent No.: US 8,584,832 B2
(45) Date of Patent: Nov. 19, 2013

(54) SYSTEM AND METHOD FOR MAILPIECE SKEW CORRECTION

(75) Inventors: Arthur H. Depoi, Brookfield, CT (US); John W. Sussmeier, Cold Spring, NY (US)

(73) Assignee: Pitney Bowes Inc., Stamford, CT (US)

( * ) Notice: Subject to any disclaimer, the term of this patent is extended or adjusted under 35 U.S.C. 154(b) by 475 days.

(21) Appl. No.: 12/632,568

(22) Filed: Dec. 7, 2009

(65) Prior Publication Data

US 2011/0132722 A1 Jun. 9, 2011

(51) Int. Cl.
*B65G 47/00* (2006.01)

(52) U.S. Cl.
USPC ..... 198/617; 198/379; 198/410; 198/415; 198/394; 271/228

(58) Field of Classification Search
USPC ..... 198/617, 379, 410, 415, 394; 271/228
See application file for complete search history.

(56) References Cited

U.S. PATENT DOCUMENTS

| | | | | | |
|---|---|---|---|---|---|
| 4,365,794 | A * | 12/1982 | Roller | 271/186 |
| 4,744,554 | A * | 5/1988 | Kulpa et al. | 271/251 |
| 4,971,304 | A * | 11/1990 | Lofthus | 271/227 |
| 5,172,907 | A * | 12/1992 | Kalisiak | 271/227 |
| 5,282,614 | A * | 2/1994 | Kalisiak et al. | 271/227 |
| 5,318,285 | A * | 6/1994 | Edwards et al. | 271/225 |
| 5,836,439 | A * | 11/1998 | Coyette | 198/415 |
| RE37,007 | E * | 1/2001 | Gerlier | 250/548 |
| 6,213,282 | B1 * | 4/2001 | Mokler et al. | 198/415 |
| 6,231,041 | B1 * | 5/2001 | Jacques | 271/121 |
| 6,659,264 | B2 * | 12/2003 | Pelka | 198/456 |
| 6,805,508 | B2 * | 10/2004 | Castleberry | 400/579 |
| 6,997,455 | B2 * | 2/2006 | Romine | 271/227 |
| 7,007,792 | B1 * | 3/2006 | Burch | 198/457.02 |
| 7,007,941 | B2 * | 3/2006 | Youn | 271/10.11 |
| 7,380,653 | B2 * | 6/2008 | Anderson et al. | 198/782 |
| 7,583,927 | B2 * | 9/2009 | Takahashi et al. | 399/395 |
| 7,588,239 | B2 * | 9/2009 | Marcinik et al. | 270/52.18 |
| 7,703,758 | B2 * | 4/2010 | Kamiya et al. | 270/58.09 |
| 7,731,169 | B2 * | 6/2010 | Saito | 270/58.12 |
| 7,775,518 | B2 * | 8/2010 | Kondo | 271/227 |
| 7,841,594 | B2 * | 11/2010 | Janatka et al. | 271/184 |
| 7,954,803 | B2 * | 6/2011 | Kitagawa et al. | 271/9.01 |
| 8,181,957 | B2 * | 5/2012 | Kondo | 271/228 |
| 2003/0155706 | A1 * | 8/2003 | Tsutoh | 271/272 |
| 2004/0239027 | A1 * | 12/2004 | Trovinger et al. | 271/227 |
| 2007/0063424 | A1 * | 3/2007 | Yahata | 271/127 |
| 2007/0132178 | A1 * | 6/2007 | Marcinik et al. | 271/226 |
| 2007/0235920 | A1 * | 10/2007 | Kawashima et al. | 271/228 |
| 2008/0128980 | A1 * | 6/2008 | Morya et al. | 271/227 |

(Continued)

*Primary Examiner* — Joseph Dillon, Jr.
(74) *Attorney, Agent, or Firm* — Steven J. Shapiro; Charles R. Malandra, Jr.

(57) ABSTRACT

A system and method for skew correction of a mailpiece includes moving the mailpiece along a path of travel in a first orientation toward a first drive roller and a second drive roller. Control of the mailpiece is established in the first orientation by the drive rollers. A first skew correction of the mailpiece is implemented by employing the first drive roller and the second drive roller to align the mailpiece with respect to the path of travel. The first drive roller and the second drive roller may be employed to change the orientation of the stopped mailpiece from the first orientation to a second orientation with respect to the path of travel. A second skew correction may be implemented by employing the first drive roller and the second drive roller to align the mailpiece in the second orientation with respect to the path of travel.

7 Claims, 9 Drawing Sheets

(56) References Cited

U.S. PATENT DOCUMENTS

2008/0150215 A1* 6/2008 Farmer ..... 271/1
2009/0057994 A1* 3/2009 Kondo ..... 271/228
2009/0096155 A1* 4/2009 Deckard ..... 271/228
2009/0107892 A1* 4/2009 Clendinning et al. ..... 209/2
2009/0250868 A1* 10/2009 Tsai et al. ..... 271/226
2010/0013149 A1* 1/2010 Kondo ..... 271/228
2011/0135369 A1* 6/2011 Hagiyama ..... 400/578

* cited by examiner

SYSTEM AND METHOD FOR MAILPIECE SKEW CORRECTION

BACKGROUND OF THE INVENTION

Various systems have been developed for the creation and processing of mail. This can involve the insertion of material into an envelope or other enclosure, the sealing of the enclosure, and printing of information on the enclosure, all of which can occur at high throughput speeds. Additional processing can involve printing of postal indicia on the enclosure and the sorting and stacking of the finished mailpiece. The systems can be organized to create mailpieces in a manner that are entitled to obtain certain favorable pricing by the mail delivery services due to the ability of the carrier such as a postal service to automate processing or where the mail is presorted or organized by carrier route.

To accomplish the various steps in the processing of the mailpiece, proper alignment and orientation of the mailpiece is needed. This facilitates high speed operation of the equipment and helps avoid equipment jams and also improper preparation of the mailpiece, as, for example, where the printing on the enclosure is not properly located. Where this occurs, the mailpiece may be rejected and diverted from the mail processing stream to be recreated. Also, where the mailpiece is not rejected and recreated, improper preparation may negatively impact downstream mail processing. For example, when a delivery point bar code or other delivery or processing code cannot be read by the processing equipment due to improper positioning or alignment on the mailpiece, alternative processing such as manual sorting may be required.

Systems for the creation and processing of mail have included arrangements to provide mailpiece enclosure alignment and orientation. For example, a mailpiece rotation module has been commercially marketed by Moore's Business Forms to change mailpiece orientation from a landscape orientation to a portrait orientation with respect to the mailpiece path of travel by means of rotating the mailpiece. However, such systems do not provide skew correction for the mailpiece, nor flexibility in the manner in which the mailpiece is controlled.

The problems associated with alignment and orientation of enclosures is exacerbated with large size mailpieces. This is the case with flats mail. Flats mailpieces are mailpieces that are larger than normal sized business type mail. The dimensions of flats mail vary from country to country. Flats mail, as defined by the United States Postal Service (USPS) in the USPS Domestic Mail Manual (DMM), is generally characterized by mailpieces that are more than 11½ inches long, or more than 6⅛ inches wide or more than ¼ inch thick. Among other items, these new standards require the delivery address to be located in the upper portion of flat-sized mailpieces mailed at automation, presorted, or carrier route prices. The new standards enable the USPS to process flat-size mailpieces in delivery sequence at high speeds and output the pieces in vertical bundles that are optimized for carrier delivery.

SUMMARY OF THE INVENTION

Improving proper alignment and orientation of a mailpiece increases the effectiveness of mail creation and processing equipment by helping to enable increased processing speed, fewer mailpiece rejects, few paper jams and enhanced downstream mailpiece processing. It also facilitates obtaining more favorable pricing from carrier delivery services. The foregoing is particularly applicable to flats mailpieces where the physical handling of the mailpiece is more difficult due to the size of the mailpiece which may be mixed in with mailpieces of other sizes.

The present invention helps to ensure mailpieces are properly aligned and oriented for processing regardless of the original alignment and orientation when the mailpiece enter the system or the orientation when the mailpiece exits the system. A system and method are provided that improve the handling of flats and other size mailpieces, including mixed mail, and provide enhanced mailpiece skew correction and proper mailpiece orientation.

A method for skew correction of a mailpiece according to an embodiment of the present invention includes moving the mailpiece along a path of travel in a first orientation with respect to the path of travel toward a first and a second drive roller. Control of the mailpiece is established in the first orientation by the first and the second drive roller. A first skew correction of the mailpiece in the first orientation is implemented by employing the first and the second drive roller to align the mailpiece with respect to the path of travel.

In accordance with another embodiment of the present invention, the method for skew correction of a mailpiece further includes employing the first drive roller and the second drive roller to change the orientation of the stopped mailpiece from the first orientation with respect to the path of travel to a second orientation with respect to the path of travel.

In accordance with yet another embodiment of the present invention, the method for skew correction of a mailpiece further includes implementing a second skew correction of the mailpiece in the second orientation by employing the first and the second drive roller to align the mailpiece in the second orientation with respect to the path of travel.

A mailpiece skew correction system embodying the present invention includes a transport adapted to move a series of mailpieces in a first orientation along a path of travel. A first drive roller and a second drive roller are mounted along the transport path of travel and positioned to receive mailpieces moved by the transport along the path of travel. The first drive roller and the second drive roller control and move mailpieces along the path of travel. A first control motor is connected to the first drive roller and a second control motor is connected to the second drive roller. A first detector and a second detector are positioned along the path of travel. The first and the second detectors provide data for the first and second control motor of detected skew of mailpieces moved along the path of travel in the first orientation under control of the first and the second drive rollers. The first control motor is operable to control the motion profile of the first drive roller and the second control motor is operable to control the motion profile of the second drive roller. The control of the motion profile of the first and the second drive rollers is based on data from the first and the second detector of detected skew of mailpieces moved along the path of travel in the first orientation is such that any mailpiece skew is corrected with respect to the path of travel and the mailpiece in the first orientation is aligned with respect to the path of travel.

In accordance with a feature of the present invention, the control of the motion profile of the first and the second drive rollers can be such that the mailpiece is stopped at a position along the path of travel after any mailpiece skew is corrected with respect to the path of travel in the first orientation and the mailpiece in the first orientation is aligned with respect to the path of travel. The orientation of the stopped mailpiece is changed from the first orientation with respect to the path of travel to a second orientation with respect to the path of travel by causing the first drive roller and the second drive roller to rotate in opposite directions.

In accordance with another feature of the present invention, the mailpiece skew correction system includes a third detector positioned along the path of travel downstream of the first detector and a fourth detector positioned along the path of travel downstream of the second detector. The third and the fourth detectors provide data for the first and second control motor of detected skew of mailpieces moved along the path of travel in the second orientation under control of the first and the second drive rollers. The control of the motion profile of the first and the second drive rollers based on data from the third and the fourth detector of detected skew of mailpieces moved along the path of travel in the second orientation is such that any mailpiece skew is corrected with respect to the path of travel and the mailpiece in the second orientation is aligned with respect to the path of travel.

DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts in the various figures.

DETAILED DESCRIPTION OF THE PRESENT INVENTION

Figure 1:
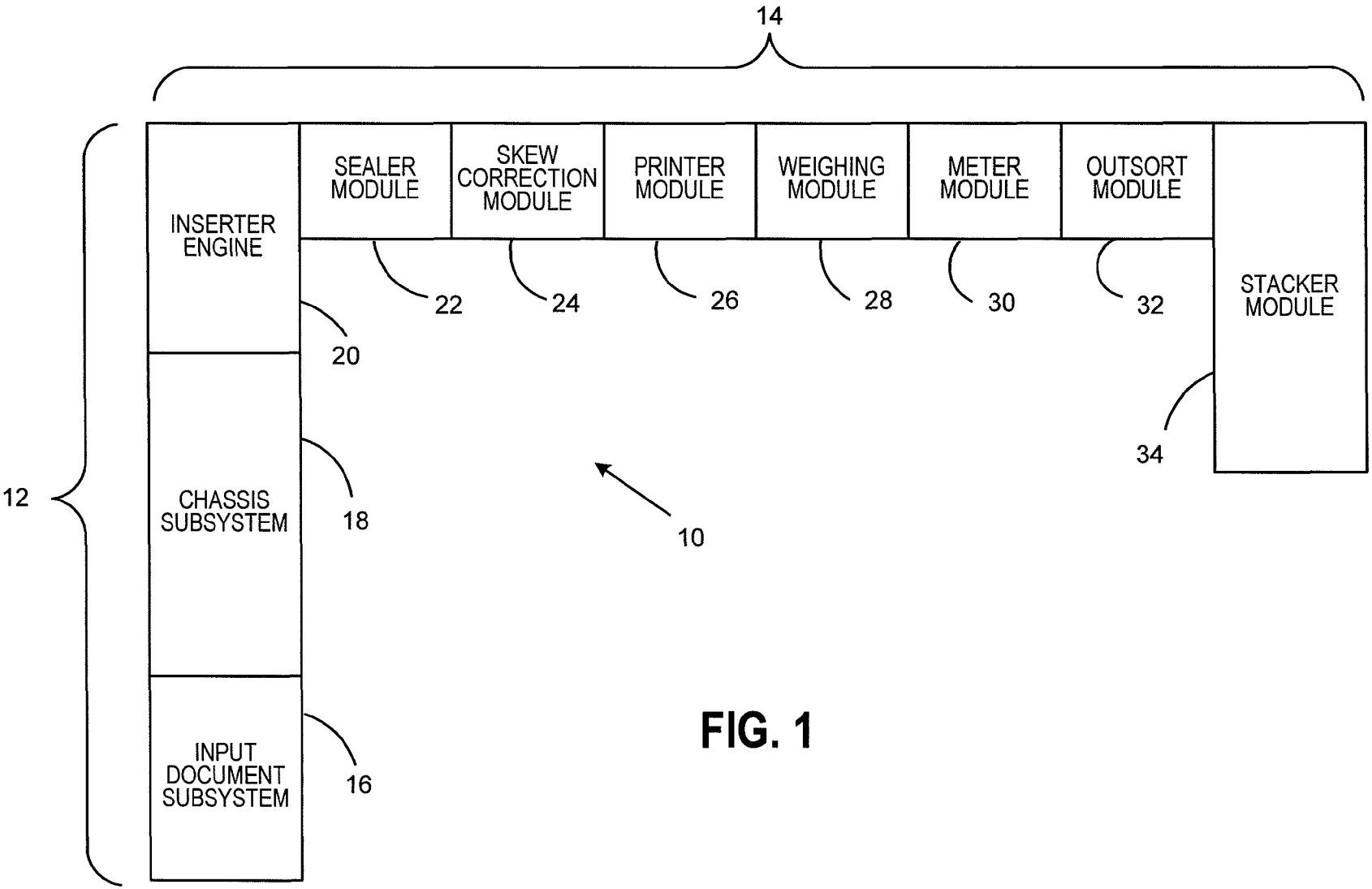
FIG. 1 is a schematic view of a system for the creation and processing of mail having a skew correction module adapted to employ the present invention.

Reference is now made to FIG. 1. An inserter system 10 includes an input subsystem 12 and an output subsystem 14. The inserter system 10 is a system for the creation and processing of mail by creating mailpieces in the input subsystem 12 for processing mailpieces in the output subsystem 14. The input subsystem 12 and output subsystem 14 can be configured in many ways. The input subsystem 12 shown includes an input document subsystem 16, which creates a control and/or other type documents, and a chassis subsystem 18, which collates various inserts with the control and/or other type documents, and an inserter engine 20. The inserter engine 20 inserts the collations into enclosures, such as envelopes, for example, to form a mailpiece.

The output subsystem 14 includes a sealer module 22 connected to the inserter engine 20 for sealing the mailpieces, as, for example, sealing an envelope flap. The sealer module 22 may feed the sealed mailpiece in a landscape orientation to a skew correction module 24, which is shown in greater detail in FIGS. 3-7.

The skew correction module 24 after having corrected for any skew in the mailpiece and, where required, changing the orientation of the mailpiece along the mailpiece path of travel, delivers the mailpiece to a printer module 26. The printer module 26 prints any needed information onto the mailpiece. The printed information can include the delivery address, the sender logo, the return address, and other information, such as a delivery point barcode. After printing, the printer module 26 delivers the mailpiece to the weighing module 28 for weighing the mailpiece to determine the correct amount of postage for the particular mailpiece. The postal indicia is thereafter printed by the meter module 30. The meter module 30 delivers the mailpiece to an outsort module 32 for selective outsorting of defective mailpieces. Properly assembled mailpieces are delivered to a stacker module 34.

The skew correction system of module 24 can be employed wherever skew correction and/or reorientation of a mailpiece is desired and need not be part of an inserter system. The inclusion of the skew correction module 24 in the inserter system 10 for the creation and processing of mail is to illustrate one type of system where the skew correction module with all the features enabled may be employed.

Figure 2:
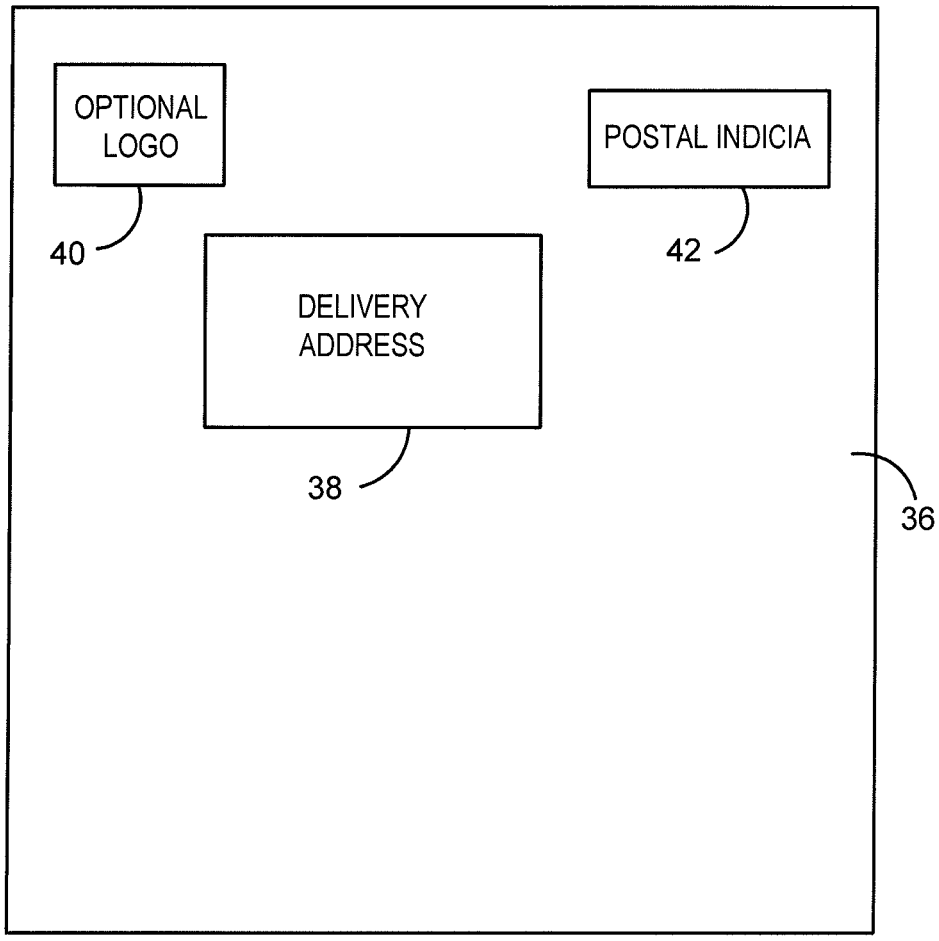
FIG. 2 is a schematic view of a flats mailpiece with printed indicia, delivery address, and optional logo or return address in vertical, portrait, orientation, that meets certain USPS requirements for favorable pricing.

Reference is now made to FIG. 2 showing a flats mailpiece 36 having information printed on the mailpiece in the appropriate locations. This includes a delivery address 38, an optional logo and/or return address 40, and postal indicia 42. Other information may also be printed on the mailpiece. The mailpiece 36 is shown in the proper orientation for printing the above information at 38, 40, and 42 in the required location for certain preferential delivery service pricing. This orientation is a portrait orientation. Where the mailpiece is originally delivered in a landscape orientation, the skew correction module 24 rotates the landscape delivered mailpiece into the proper portrait orientation for downstream processing by the system. Portrait orientation is typically required for various operations such as printing, sorting, and stacking of flats mailpieces.

Figure 3:
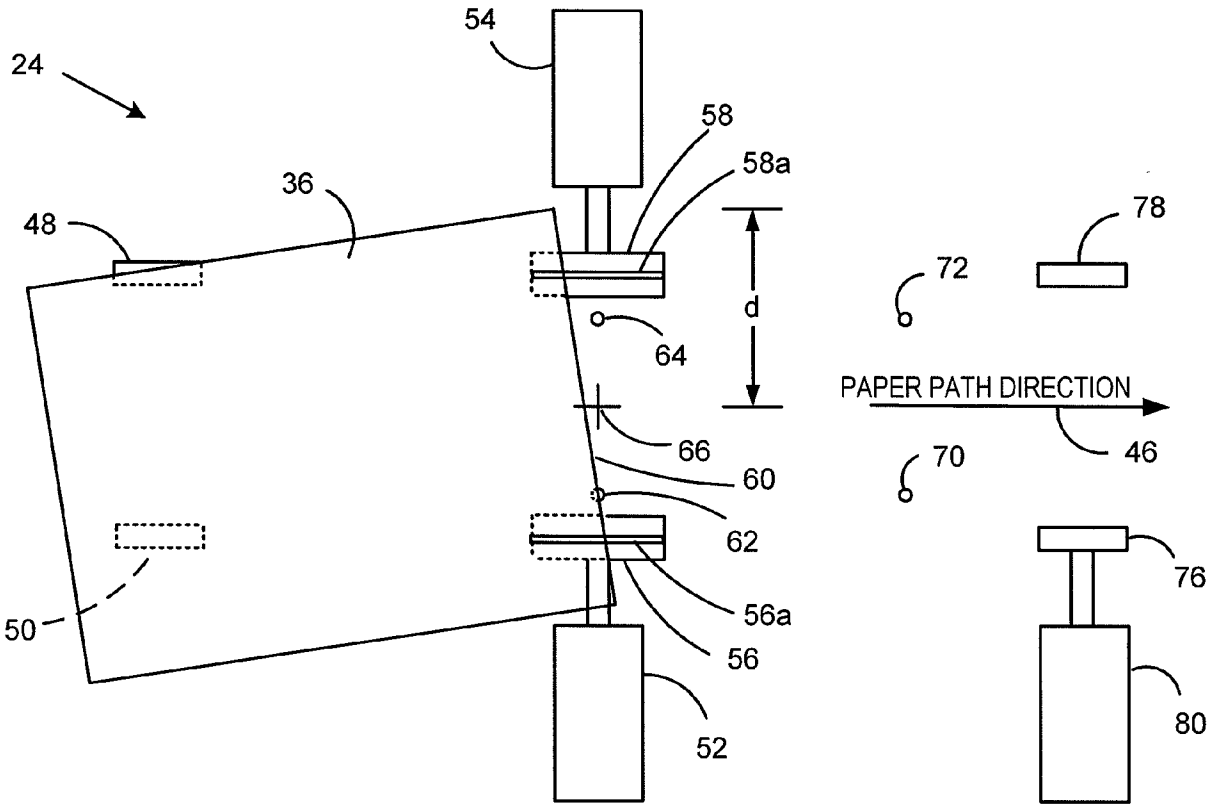
FIG. 3 is a top view of a mailpiece skew correction system according to an embodiment of the present invention, capable of first and second mailpiece skew correction and with certain idler rollers removed to facilitate an understanding of the structure and operation of the module, and illustrating a skewed mailpiece entering the module.
Figure 7:
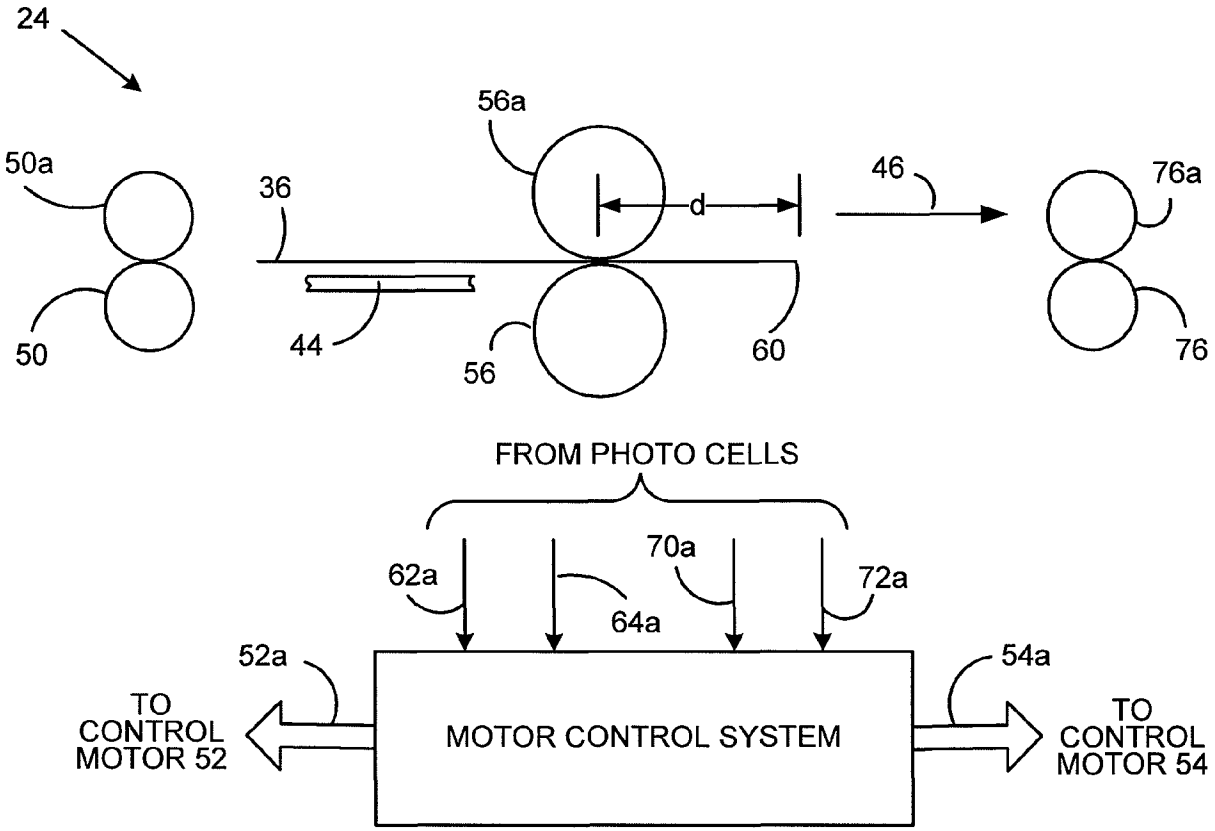
FIG. 7 is an elevation view of the mailpiece skew correction system shown in FIGS. 3-6 with the idler rollers shown and with the mailpiece positioned as shown in FIG. 4.

Reference is now made to FIG. 3. The mailpiece 36 without the printed information is shown as entering the skew correction module 24 in a skewed manner. The skew of the mailpiece with respect to the path of travel can be in either direction. The mailpiece 36 is driven over a deck 44 (shown in FIG. 7) in the paper path direction 46 by a series of constantly rotating drive rollers 48 and 50 which cooperate with spring loaded idler rollers, not shown in FIG. 3. These drive rollers are part of a transport for the mailpiece. Other transport arrangements, such as belt transport systems, may also be employed. The spring loaded idler roller associated with driven roller 50 is shown in FIG. 7 as idler roller 50*a*. The skewed mailpiece 36 is driven in the paper path direction 46 until it is captured by a set of rollers driven by a first control motor 52 and a second control motor 54. These control motors 52 and 54 are connected to driven rollers 56 and 58, respectively, to provide motion control for the rollers. The motors 52 and 54 are of the type which can control the direction and rotational speed of the respective drive rollers 56 and 58.

The rollers 56 and 58 cooperate with spring loaded upper rollers 56*a* and 58*a*, respectively. In the illustrated embodiment, the drive rollers 56 and 58 are significantly wider than the spring loaded idler rollers 56*a* and 58*a*. The difference in width is approximately a 4 to 1 ratio, with the idler rollers 56*a* and 58*a* having, for example, a width of 1/16 of an inch and the drive rollers 56 and 58 having a width 4/16 of an inch. The two upper idler rollers 56*a* and 58*a* are narrow and have a rounded cross section at the roller periphery. Thus, there is nearly a point contact with the respective lower drive rollers 56 and 58, which facilitates rotation of the mailpiece 36 to change the mailpiece orientation from a landscape orientation to a portrait orientation. The rotation process is described in connection with FIGS. 4 and 5.

Once the mailpiece 36 is captured between the nips of the drive rollers 56 and 58 and associated idler rollers 56*a* and 58*a*, and has exited the nip of the constantly rotating drive roller 48 and associated idler roller (not shown) and drive roller 50 and associated idler roller 50*a*, the mailpiece is positioned so that it is suitable for skew correction by a first skew correction process, and for rotation to the proper orientation for subsequent processing, where needed.

As the mailpiece is moved under control of the drive rollers 48 and 50 and into the control of drive rollers 56 and 58, the leading edge 60 of the mailpiece 36 in landscape orientation passes photo detector cells 62 and 64 (hereinafter "photocells"). The photocells detect the misalignment of the mailpiece 36 in the paper path direction 46 and provide this information to the control motors 52 and 54 via connections 62*a* and 64*a* connected to the motor control system 55, as shown in FIG. 7. The motor control system 55 is connected to the control motor 52 by connection 52*a* and to the control motor 54 by connection 54*a*. Various arrangements may be employed in providing the information to the control motors other than by means of a separate motor control system, and various locations can be employed in positioning the various detectors along the path of travel.

The drive rollers 56 and 58 are initially rotating in the same direction and at the same speed as the constantly rotating drive rollers 48 and 50 when the lead edge 60 of the landscape-oriented mailpiece 36 engages the nips of the drive rollers 56 and 58 and associated idler rollers 56*a* and 58*a*. The detected misalignment (i.e., skew) of the mailpiece 36 provides the control motors 52 and 54 the needed information to impart a differential motion profile via independent control of the rotational speed and direction of the drive rollers 56 and 58 for the mailpiece 36 to be fully skew-corrected when the leading edge 60 of the mailpiece is stopped a distance d (shown in FIGS. 4 and 7) along the path of travel 46 from the center of rotation 66 of the mailpiece 36. The center of rotation 66 is the axis of rotation when the mailpiece orientation is changed. The mailpiece 36 is moved, decelerated, and stopped along the path of travel 46 with the mailpiece 36 skew-corrected and the leading edge 60 of the landscape-oriented mailpiece 36 downstream of the center of rotation 66 by the distance d.

The control motors 52 and 54, via the drive rollers 56 and 58 and associated idler rollers, convey the mailpiece leading edge 60 the same distance d from the photocells 62 and 64 in the direction of travel as they decelerate the mailpiece 36 to zero velocity. The separate motion profiles cause the mailpiece leading edge 60 (shown in FIG. 4) to be positioned perpendicular to the paper path direction 46. The separate motion profiles, which together define a differential motion profile, may introduce a slight translation of the mailpiece 36 perpendicular to the direction of travel. The desired position of the center of the mailpiece leading edge 60 is exactly between the nip of the drive roller 56 and associated idler roller 56*a* and the nip of drive roller 58 and associated idler roller 58*a*. Any error perpendicular to the direction of travel will result in an error parallel to the direction of travel after the rotation. Likewise, any error parallel to the path of travel will result in an error perpendicular to the direction of travel.

Figure 4:
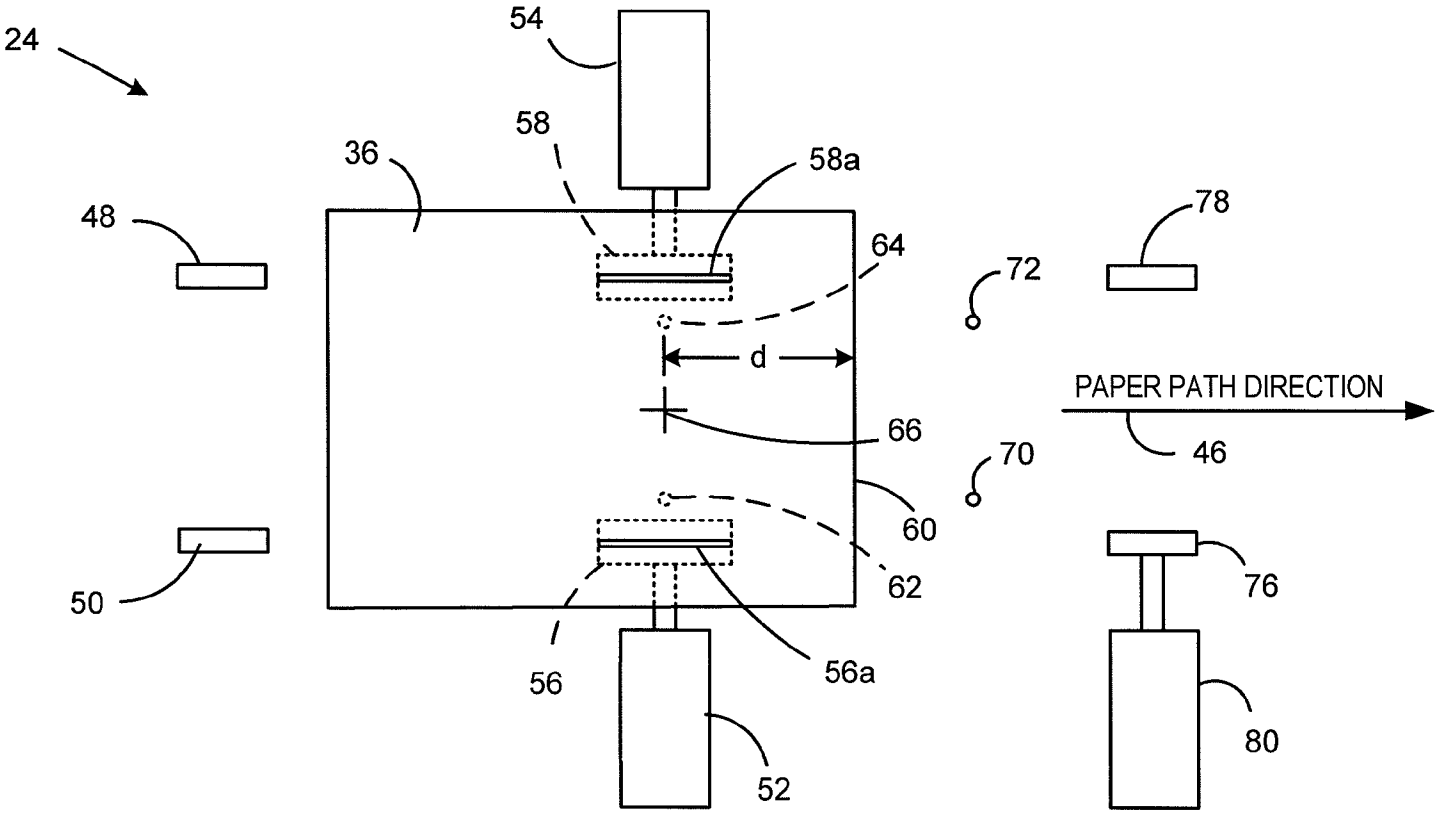
FIG. 4 is a top view of the mailpiece skew correction system shown in FIG. 3 with the skew of the skewed mailpiece shown in FIG. 3 corrected by a first skew correction process.

During the deceleration, eventually the leading edge 60 of the landscape-oriented mailpiece 36 will block one of the photocells 62 or 64 followed by the other photocell, with the duration between the two events depending on the severity and direction of the mailpiece skew. Motion control for the motors 52 and 54 de-skews the landscape-oriented mailpiece 36 before the mailpiece is stopped, as shown in FIG. 4. This is accomplished by measuring the displacement difference between the photocell 62 and 64 events, specifically the detection by each photocell 62, 64 of the leading edge 60 of the landscape-oriented mailpiece 36.

Once the leading edge 60 has blocked the second photocell, the motors 52 and 54 independently decelerate at different rates to deliver the leading edge 60 of the landscape-oriented mailpiece 36 the fixed distance d downstream of the respective photocells 62, 64 at precisely the same time to the stopped position. This differential motion control of the mailpiece 36 results in correction of any skew of the landscape oriented mailpiece when the mailpiece is stopped. The leading edge 60 of the landscape-oriented mailpiece 36 is stopped perpendicular to the paper path direction 46. This alignment is a result of the first skew correction process.

Figure 5:
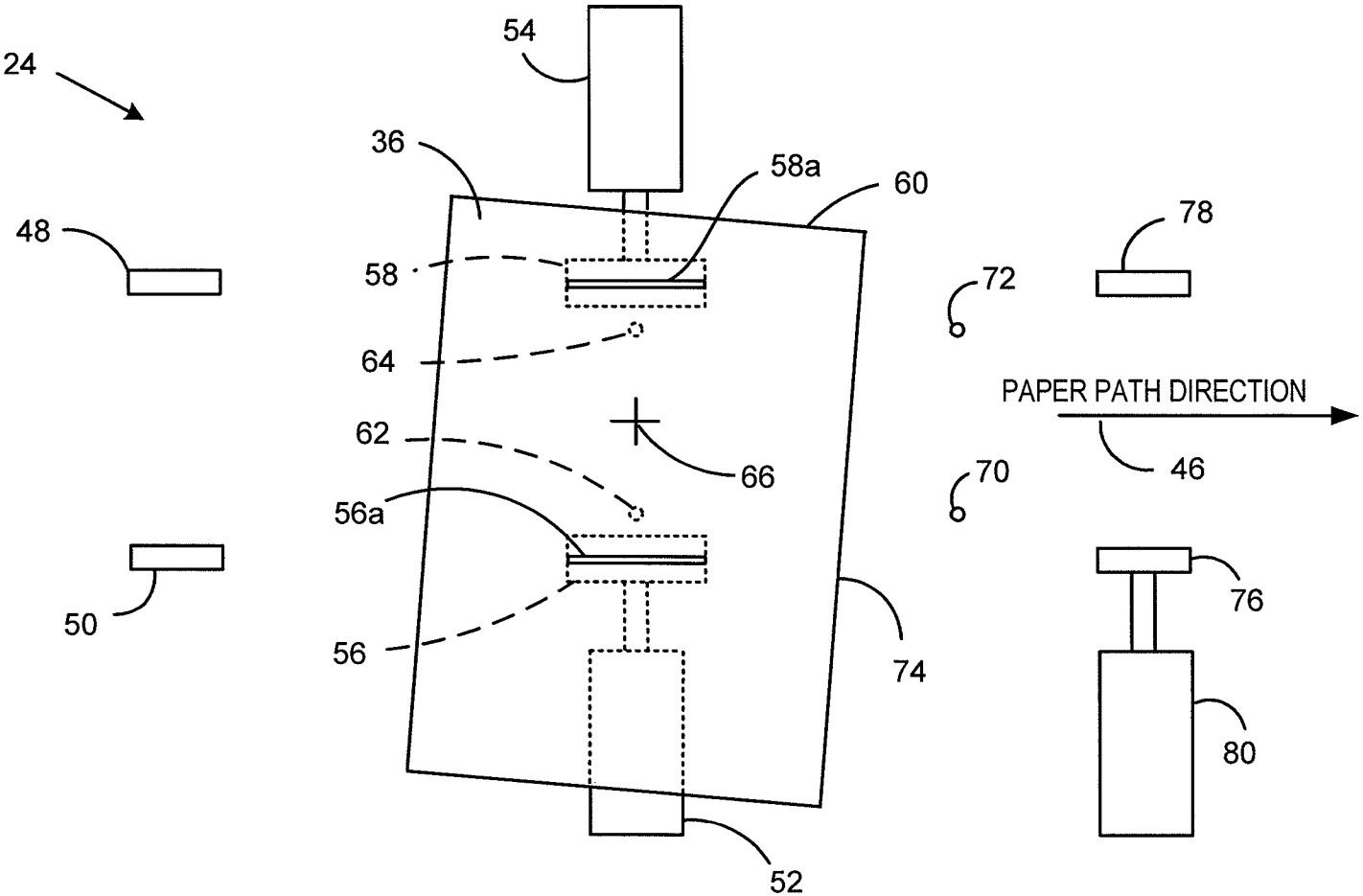
FIG. 5 is a top view of the mailpiece skew correction system shown in FIGS. 3 and 4 with the skew corrected mailpiece shown in FIG. 4 rotated from a landscape to a portrait orientation and with an exaggerated amount of skew shown as having been introduced during the rotation of the mailpiece, the skew being exaggerated for a better understand of the present invention.
Figure 6:
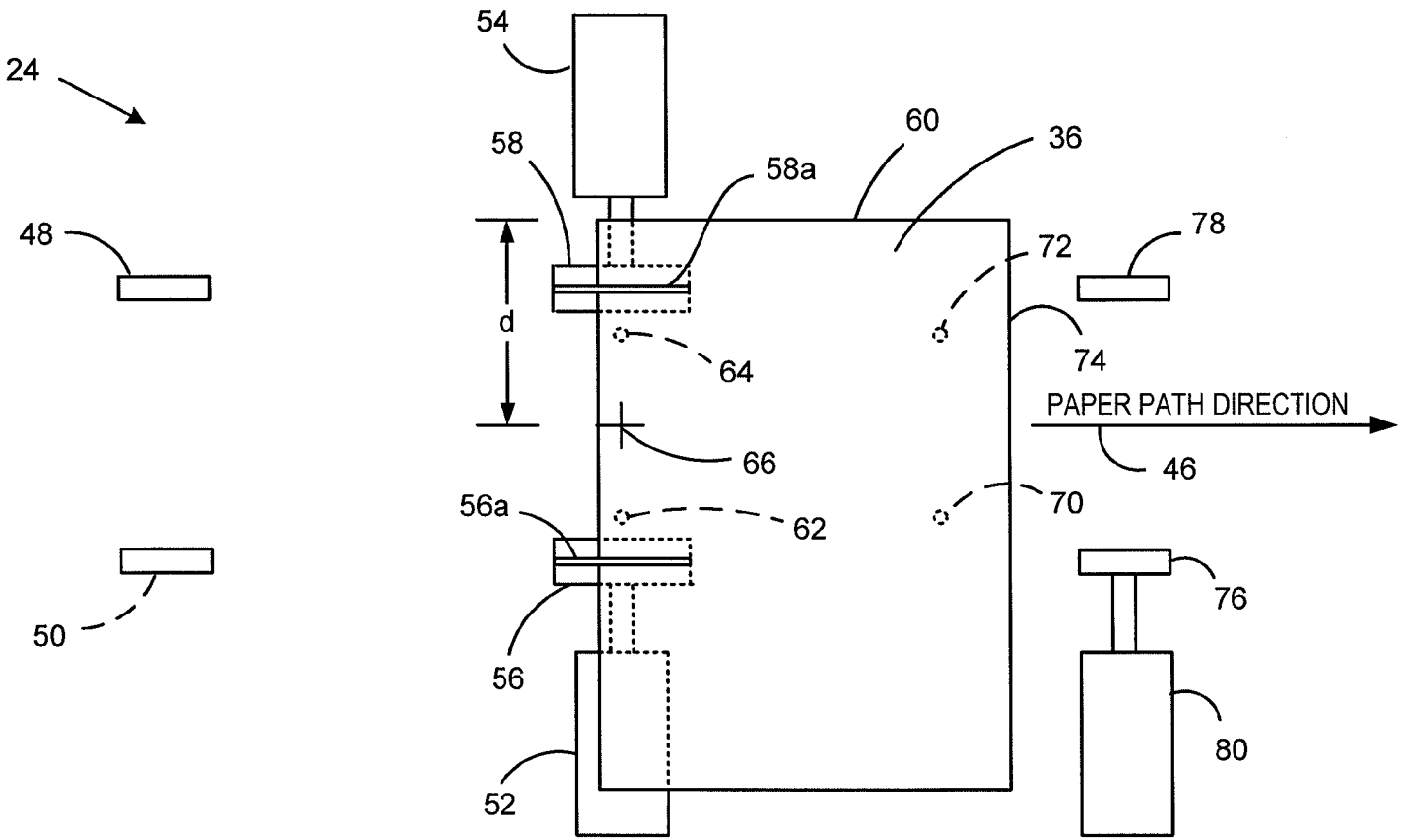
FIG. 6 is a top view of the mailpiece skew correction system shown in FIGS. 3-5 with the skew of the rotated mailpiece corrected by a second skew correction process.

When the mailpiece 36 has decelerated and stopped, the drive roller 56, under control of motor 52, and the drive roller 58, under control of motor 54, rotate in opposite directions and rotate the mailpiece 36 approximately 90 degrees, to change the orientation of the mailpiece 36 with respect to the path of travel. The mailpiece orientation is changed from a landscape orientation, as shown in FIGS. 3 and 4, to a portrait orientation, as shown in FIGS. 5 and 6. This rotation positions the mailpiece 36 in the proper orientation for downstream processes, such as printing and sorting. However, after the rotation process, skew may still exist in the mailpiece. The skew in the mailpiece in FIG. 5 has been exaggerated in extent from that typically encountered during rotation of the mailpiece, such as a flats mailpiece, which may be in the order of one or two degrees, depending on various factors such as those described below.

The thickness of the mailpiece may affect the amount of skew that remains after the 90 degree mailpiece rotation. As mailpieces get thicker, the amount of physical rotation from the same motion profile may be less than 90 degrees due to a higher degree of slippage in the nips with heavy, puffy mailpieces. Thus, thicker mail tends to have an actual rotation less than the desired 90-degree rotation. Accordingly, varying degrees of skew may be reintroduced during the 90-degree rotation. The amount of skew introduced by the rotation process may vary based on the implementation of the mechanism rotating the mailpiece, such as the speed of rotation, the material of the rollers, the material of the mailpiece deck supporting the mailpiece, and also based on the nature of the mailpiece, such as the material, the dimensions (i.e., size and thickness), and the puffiness (e.g., compressibility) of the mailpiece, and other factors. The specific motion profile of each of the drive rollers 56 and 58 under control of their respective drive motors, which are in opposite directions to effectuate the rotation, may also be a factor in any introduced skew. To compensate for this skew introduced by the rotational process, an additional, second skew correction process can be enabled after the rotation of the mailpiece 36.

When the rotation process is completed, the mailpiece 36 is accelerated from rest in the paper path direction 46 and passes photocells 70 and 72. The photocells detect misalignment of the mailpiece 36 in the paper path direction 46 and provide this information to the control motors 52 and 54 via connections 70*a* and 72*a* connected to the motor control system 55, as shown in FIG. 7. The motor control system 55 is connected to the control motor 52 by connection 52*a* and to control motor 54 by connection 54*a*. Other arrangements may also be employed in providing the information to the control motors.

During the acceleration, eventually the leading edge 74 of the portrait-oriented mailpiece will block one of the photocells 70, 72 followed by the other photocell, with the duration between the two events depending on the severity of the mailpiece skew generated during the rotation move. The control motors 52 and 54 provide motion control for the drive rollers 56, 58 to de-skew the mailpiece 36 before the leading edge 74 of the portrait-oriented mailpiece reaches the nips of the skew correction module 24 exit rollers. This is accomplished by measuring the displacement difference between the photocell 70 and 72 events, specifically, the detection by each photocell of the leading edge 74 of the portrait-oriented mailpiece. The skew correction module exit rollers comprise a drive roller 76, and an associated spring loaded idler roller 76*a*, and a drive roller 78, and an associated spring loaded idler roller (not shown). The exit drive rollers 76 are driven by a motor 80. The drive rollers 48, 50, 76, and 78 are each rotated at a constant speed. The drive motor 80, which directly drives the exit drive roller 76, can also be employed to drive the other drive rollers 48, 50, and 78, such as by means of a drive belt arrangement (not shown) mounted below the deck 44.

Once the leading edge 74 has blocked the second photocell, the motors 52, 54 independently accelerate at different rates to deliver the leading edge 74 of the portrait-oriented mailpiece to a fixed distance downstream of the respective photocells 70, 72 at precisely the same time and velocity before reaching the exit roller nips. This differential motion control of the mailpiece 36 results in correction of any skew, and positions the top 60 of the mailpiece 36 at the distance d from the center of rotation, as shown in FIG. 6. The top 60 of the portrait-oriented mailpiece is parallel to the paper path direction 46, and the leading edge 74 of the portrait-oriented mailpiece is perpendicular to the paper path direction 46. This alignment is a result of the second skew correction process. The top 60 of the portrait oriented mailpiece 36 was previously the lead edge of the mailpiece 36 when in landscape orientation, as shown in FIGS. 3 and 4.

During the second skew correction process, one of the motors 52 and 54 drives its driven drive roller at a first rate of speed and the second motor will drive its driven drive roller at a greater speed or lesser speed to correct for the remaining skew. However, many different drive arrangements may be implemented, with both drive rollers have varying and different motion profiles for the mailpiece skew correction provided by the first and the second skew correction process. When the mailpiece is captured by the driven rollers 76 and 78 and associated spring loaded idler rollers to exit the skew correction module 24, skew has been essentially eliminated within the tolerances established for the system and the mailpiece 36 is thereafter presented in aligned and proper orientation for further processing by subsequent modules.

The distance d shown in FIGS. 4 and 7 and the distance d shown in FIGS. 3 and 6 are equal, although they are in a different orientation. As shown in FIGS. 3 and 6, the distance d is the distance from the portrait-oriented mailpiece top edge 60, after rotation and the second skew correction process, to the rotation center 66. As shown in FIGS. 4 and 7, the distance d is also the distance from the leading edge 60 of the landscape-oriented mailpiece, after the mailpiece has been stopped and the first skew correction implemented, to the rotation center 66.

Figure 8:
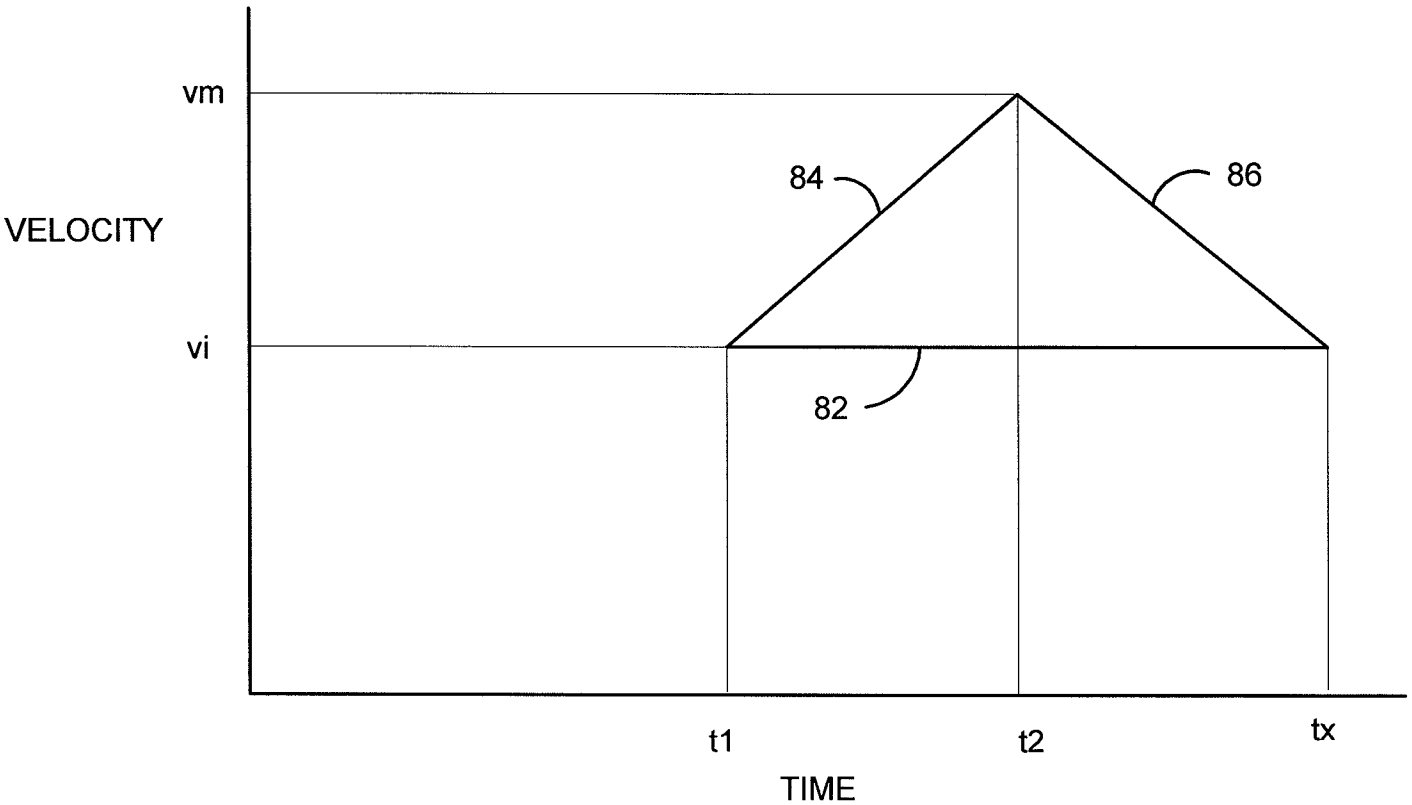
FIG. 8 is a graph depicting features of the second skew correction process of the skew correction system shown in FIGS. 3 and 4; and, FIG. 9 is a flow chart of the operation of the mailpiece skew correction system shown in FIGS. 3-7 with the first and second mailpiece skew correction process enabled.

Reference is now made to FIG. 8. FIG. 8 is an example of one of many motion profiles that may be employed for the skew correction module 24 drive rollers 56 and 58. The motion control profile shown in FIG. 8 is for the second skew correction process after the mailpiece rotation has occurred. This profile corrects for any remaining skew of the mailpiece, including skew introduced by the rotation process. In the motion profile shown, one of the drive rollers 56 or 58, as previously noted, is rotating at a constant speed. The other drive roller rotates at a different speed, faster or slower, to provide the skew correction. The initial velocity vi of the roller that is correcting the skew is equal to the constant velocity vi of the other roller shown at t1. The drive roller rotating at constant rotational velocity vi for the period of time t1 through tx during the skew correction process is shown by line 82. The other drive roller, from vi at t1, runs at an increasing rotational velocity for the period of time t1 through t2, and is shown by line 84. The rotational velocity of this roller increases to a maximum speed vm at t2. Thereafter, the rotational velocity decreases for the period of time t2 through tx, and is shown by line 86. The rotational velocity of this roller decreases in rotational velocity and decelerates to the speed vi at tx. At time tx the mailpiece has been skew corrected by the second skew correction process and both drive rollers 56 and 58 are rotating at the same speed vi. The portrait oriented mailpiece 36 is moved under control of the drive rollers 56 and 58 and the associated idler rollers 56*a* and 58*a* toward the nips of the exit rollers. It should be noted that this skew correction does not necessarily have to occur with one of the drive rollers 56, 58 rotating at constant speed. Instead, corrective differential motion may be achieved by these rollers accelerating from rest at slightly different acceleration rates to achieve the skew correction.

Figure 9:
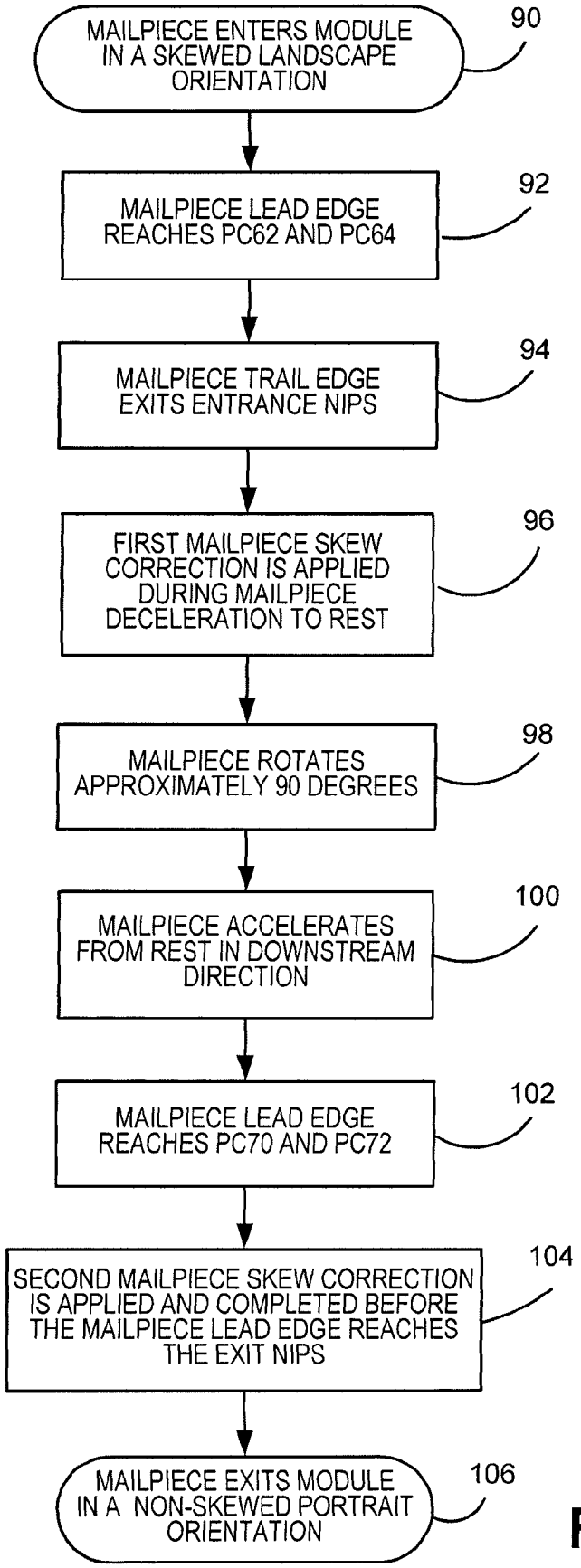

Reference is now made to FIG. 9 which is a flow chart of the operation of the skew correction module 24, shown in FIGS. 3-7. At block 90 a mailpiece enters the skew correction module 24 in a landscape orientation. In many instances the mailpiece is skewed as it enters at block 90. At block 92 the leading edge of the mailpiece reaches the photocells 62, 64. The trailing edge of the mailpiece exits the entrance roller nips at block 94 and the first mailpiece skew correction is applied during the mailpiece deceleration to rest at block 96. The mailpiece rotates approximately 90 degrees at block 98 after the mailpiece has come to rest. The mailpiece at block 100 accelerates from rest in a downstream direction, and at block 102 the mailpiece lead edge reaches photocells 70 and 72. At block 104 the second mailpiece skew correction is applied and completed before the mailpiece lead edge reaches the exit roller nips. The mailpiece then exits the skew correction module 24 in non-skewed portrait orientation at block 106.

As described above, the skew correction module 24 can have mailpieces presented to the module from upstream module that are substantially skewed. When this occurs, if the first skew correction process is not employed, and the rotate module provides a rotation angle that is exactly 90 degrees, the mailpiece will exit the module with the same amount of skew as when the mailpiece was presented to the skew correction module 24. Also, since as mailpieces get thicker, the amount of physical rotation becomes less than 90 degrees, the original skew may be increased or decreased, and will generally leave the skew correction module 24 skewed unless the nature of the original skew is exactly offset by the skew introduced by the rotational process. Thus, both sources of skew can, for example, result in indicia and address printing that will not be properly aligned with the mailpiece and will also result in an increased frequency of paper jams in downstream modules.

However, when the first mailpiece skew correction process is applied before the mailpiece has come to the stopped position and before the mailpiece is rotated 90 degrees, the original skew of the mailpiece is corrected. At this time, the landscape-oriented mailpiece lead edge has moved a predetermined distance to the stopping point and rotation is applied to the mailpiece. As the portrait-oriented mailpiece is accelerated from the rotated, stopped position toward the skew correction module exit, the second mailpiece skew correction process is applied and any skew introduced by the rotational process is corrected.

Moreover, should the first skew correction process not fully eliminate the original skew, the second skew correction process can eliminate and correct any remaining original skew and any skew introduced from the rotation process. With the two drive rollers 56, 58 and the associated idler rollers 56*a*, 58*a* under control of the control motors 52, 54, two skew correction processes are implemented and the mailpiece orientation is changed for subsequent processing. By aligning the mailpiece, whether in the first or the second orientation, with respect to the path of travel, any skew of the mailpiece is corrected. When the mailpiece skew has been corrected, the mailpiece is aligned with respect to the path of travel.

In many instances the second skew correction process may not be needed and can be disabled or omitted from the skew correction module. For example, in those instances where mailpiece orientation rotation is employed and the amount of skew, if any, introduced by the rotation process is within acceptable limits, any such skew can remain uncorrected without adversely impacting subsequent operations. Also, where the mailpiece exits the skew correction module in landscape orientation, the second skew correction process is not required and can be omitted or implemented at a subsequent point in the process if the mailpiece is rotated from a landscape to a portrait orientation. In such case, another set of motor controlled drive rollers may be employed.

The present system may provide flexibility in the control of the mailpiece. The system can employ one or two skew correction processes. The system can handle mixed mail having various thicknesses and can skew correct mailpieces after the mailpiece orientation has been completed. Moreover, the system can be configured to bypass normal size mail in the mail stream by moving the mailpiece through the skew correction module without processing such mail or implement only a first skew correction process, if desired.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A method for skew correction of a mailpiece while changing the orientation thereof, comprising the steps of:

conveying the mailpiece along a path of travel by a conveyance system having first and second drive rollers, the mailpiece having a first orientation with respect to the path of travel;

detecting a skew misalignment of the mailpiece at a first location along the path of travel while the mailpiece is in the first orientation;

controlling the first and second rollers in accordance with a first skew correction motion profile the first skew correction motion profile effecting differential motion of the drive rollers to rotate and align the mailpiece with respect to the path of travel;

conveying the mailpiece along the path of travel a predetermined distance downstream while the mailpiece is under the control of both the first and second drive rollers;

stopping the mailpiece at a mailpiece stop position along the path of travel after the mailpiece has been conveyed the predetermined distance; and changing the orientation of the stopped mailpiece from the first orientation to a second orientation with respect to the path of travel by rotating the first and second drive rollers in opposite directions, conveying the mailpiece along the path of travel by the first and second drive rollers while in the second orientation;

detecting a skew misalignment of the mailpiece at a second location along the path of travel downstream of the first location and while the mailpiece is in the second orientation; and controlling the first and second rollers in accordance with a second skew correction motion profile, the second skew correction motion profile effecting differential motion of the drive rollers to rotate and align the mailpiece with respect to the path of travel.

2. The method of claim 1, wherein the step of detecting of the skew misalignment of the mailpiece while in the first orientation includes a first pair of detectors positioned along the path of travel of the mailpiece upstream of the mailpiece stopped position.

3. The method of claim 1, wherein the step of detecting skew misalignment of the mailpiece while in the second orientation includes a second pair of detectors positioned along the path of travel downstream of the mailpiece stopped position.

4. The method of claim 1, wherein the first driver roller is adapted to cooperate with a first idler roller and the second drive roller is adapted to cooperate with a second idler roller and wherein the width of each idler roller is smaller than the width of each drive roller to facilitate the changing of the orientation of the mailpiece from the first orientation with respect to the path of travel to the second orientation with respect to the path of travel.

5. The method of claim 1, wherein the mailpiece is a flats type mailpiece and the first orientation with respect to the path of travel is a flats mailpiece landscape orientation and the second orientation with respect to the path of travel is a flats mailpiece portrait orientation.

6. The method of claim 1, wherein the mailpiece is rotated by the first drive roller and the second drive roller around a center of rotation to change the orientation of the mailpiece from the first orientation with respect to the path of travel to the second orientation with respect to the path of travel and wherein the leading edge of the mailpiece in the first orientation is stopped the predetermined distance downstream of the of center of rotation.

7. The method of claim 1, wherein the mailpiece is rotated approximately 90 degrees from the first orientation to the second orientation along the path of travel.

* * * * *